US006004380A

United States Patent [19]

Landreau et al.

[11] Patent Number: 6,004,380

[45] Date of Patent: Dec. 21, 1999

[54] GAS DRYING PROCESS USING GLYCOL, INCLUDING PURIFICATION OF DISCHARGED GAS

[75] Inventors: Benoit Landreau, Chatenay Malabry; Jean-Claude Amande, Villepreux; Nicole Doerler, Nanterre; Alenxandre Bojey, Rueil Malmaison, all of France

[73] Assignees: Nouvelles Applications Technologiques; Institut Francais du Petrole, both of France

[21] Appl. No.: 08/738,690

[22] Filed: Oct. 28, 1996

[30] Foreign Application Priority Data

Oct. 27, 1995 [FR] France ..... 95 12689

[51] Int. Cl.[6] ..... B01D 53/14

[52] U.S. Cl. ..... 95/174; 95/180; 95/184; 95/194; 95/231; 95/237; 96/181; 96/201

[58] Field of Search ..... 55/257.1, 257.7; 95/156, 158, 174, 180, 184, 186, 193, 194, 231, 237; 96/181, 201, 218

[56] References Cited

U.S. PATENT DOCUMENTS

| | | | |
|---|---|---|---|
| 3,855,337 | 12/1974 | Foral, Jr. et al. | 260/674 R |
| 5,084,074 | 1/1992 | Beer et al. | 95/193 |
| 5,209,762 | 5/1993 | Lowell | 95/193 |
| 5,346,537 | 9/1994 | Lowell | 95/184 |
| 5,399,188 | 3/1995 | Roberts | 95/186 |
| 5,490,873 | 2/1996 | Behrens et al. | 95/174 |
| 5,520,723 | 5/1996 | Jones, Jr. | 95/231 |
| 5,536,303 | 7/1996 | Ebeling | 95/194 |

FOREIGN PATENT DOCUMENTS

| | | |
|---|---|---|
| 0 218 359 | 4/1987 | European Pat. Off. . |
| 2 142 041 | 1/1985 | United Kingdom . |

*Primary Examiner*—C. Scott Bushey
*Attorney, Agent, or Firm*—Millen, White, Zelano & Branigan, P.C.

[57] ABSTRACT

A process for dehydrating a natural gas or refinery gas containing water and BTEX using a liquid desiccant (glycol) and including regeneration provides the following steps:

(a) absorption of the water and the BTEX by contacting the gas with the liquid desiccant which has been regenerated in step (c), producing a dry gaseous effluent and the liquid desiccant charged with water and BTEX;

(b) separating the charged liquid desiccant into a vapor containing a portion of the BTEX and a liquid phase containing mainly desiccant charged with water and BTEX;

(c) regenerating the liquid desiccant in a distillation zone from which a vapor containing water and BTEX and regenerated liquid desiccant are extracted, the latter being sent to absorption step (a);

(d) condensing the vapor from the distillation zone and separating it into three phases: a gaseous effluent containing BTEX, a liquid hydrocarbon phase containing BTEX, and an aqueous liquid phase; and (e) washing the gaseous effluent by absorbing the BTEX in a fraction of regenerated desiccant liquid removed from a point in the process and returning the desiccant to a point in the regeneration zone of step (c).

18 Claims, 7 Drawing Sheets

A1
B1
C1
D1
E1
E4
P1
R1
R2
S1
Air
1
2
3
4
5
6
7
8
9
10
11

GAS DRYING PROCESS USING GLYCOL, INCLUDING PURIFICATION OF DISCHARGED GAS

FIELD OF THE INVENTION

The invention concerns a process for dehydrating gas using a liquid desiccant (glycol) including a purification step for the gaseous effluents emitted during regeneration of the liquid desiccant. More particularly, the invention concerns a process for reducing the pollution due to gaseous discharges from natural gas drying units. The pollution is essentially due to at least one of the following aromatic compounds: benzene, toluene, ethylbenzene, and xylenes (BTEX).

BACKGROUND OF THE INVENTION

Dehydration of a gas, for example a natural gas or a refinery gas, is a conventional operation. It allows the dew point of the gas to be controlled, to prevent the formation of hydrates or ice during transport or use of the gas; it can reduce the risk of corrosion, etc. . . . .

To this end, the gas is currently brought into contact with a hydrophilic liquid desiccant; of these, glycols are very widely used. Triethyleneglycol (TEG) is used most frequently in almost 95% of cases, because of its high affinity for water, its chemical stability and its low cost. However, for certain applications, monoethyleneglycol (MEG), diethyleneglycol (DEG) or tetraethyleneglycol (T4EG) may be preferred.

In a conventional gas dehydration unit using a liquid desiccant, for example glycol, as shown in the accompanying FIG. 1, the wet gas enters via line 1 at the bottom of an absorption column A1, operating under pressure, where it contacts a counter-current of liquid desiccant introduced overhead via line 3. During contact, the water contained in the gas is absorbed by the desiccant. The dehydrated gas leaves absorption column A1 overhead at high pressure via line 2. The desiccant charged with water leaves the bottom of column A1 and is sent via line 4 to the head of a regeneration unit R1 where it is used as a cooling fluid. After heat exchange, the desiccant charged with water is sent to a flash separation drum S1 where the pressure is lower than in absorption column A1. In some cases, the desiccant charged with water is first sent to the flash separation drum before using it as a cooling fluid at the head of regeneration unit R1. A large portion of the gas absorbed at high pressure by the desiccant is separated from the liquid phase in drum S1. The gas can either be discharged into the atmosphere via line 5 or used as fuel gas during the desiccant regeneration step, in which case it is sent to the burner of reboiler R2 of regeneration apparatus R1.

The liquid desiccant containing water, but separated from the gas absorbed at high pressure, leaves the flash separation drum via line 7. After passage through at least one heat exchanger E1, it is sent via line 7 to thermal regeneration apparatus R1, in which a portion of the water absorbed by the desiccant is vaporised and eliminated overhead via line 8, while the regenerated desiccant which leaves via line 3 passes through exchanger E1 and is sent via a pump P1 through cooler E4 then to the head of absorption column A1.

It is known, however, that the water cannot be completely separated from the desiccant using a thermal route at atmospheric pressure since the desiccant degrades at a temperature below its normal boiling point. As an example, TEG boils at about 285° C., but a limit of 204° C. is generally applied during regeneration to limit degradation. At this temperature, the purity of the regenerated TEG is close to 98.7% by weight.

When greater purity is desired for the liquid desiccant (glycol) in order to produce more effective dehydration of the gas, a conventional method consists of following the thermal reconcentration step by a stripping step using a gas which is dry or contains a small amount of water, for example a portion of the gas stream which has been dehydrated by the desiccant, as described in particular in United States patent U.S. Pat. No. 3,105,748.

A further technique consists of following the reconcentration step by a stripping step using a liquid stripping agent at ambient temperature and pressure and forming a heteroazeotrope with water. This configuration, which is described in French patent FR-B-2 698 017 in particular, comprises:

1. a reboiling step for the liquid desiccant charged with water;
2. a desiccant distillation step comprising at least one distillation stage;
3. a stripping step for the liquid desiccant which has been partially regenerated during steps 1 and 2, using the vaporised stripping agent;
4. a step for condensing the vapour leaving distillation step 2, to generate two liquid phases, one being mainly water, the other being mainly stripping agent;
5. heating the liquid phase which is rich in stripping agent from step 4, said heating regenerating a vapour phase which is richer in water than said liquid phase and a liquid phase which is depleted in water;
6. returning the liquid phase constituted essentially by stripping agent from step 5 to step 3.

In dehydration processes, when the treated natural gas or refinery gas contains aromatic compounds (BTEX): at least one of benzene, toluene, ethylbenzene and xylene), during the absorption phase, the desiccant—generally TEG—which is also a solvent for aromatic compound, becomes charged with BTEX.

Because of the boiling points of BTEX at atmospheric pressure, i.e., in the range 80° C. to 144° C., little of these compounds are separated from the desiccant in the flash separation drum described above, which operates at low pressure and high temperature. The majority of the aromatic compounds are separated from the desiccant when it is heated in the regeneration column.

The vapours emitted by a TEG reboiling unit can have a very high total aromatic content (more than 30%). By way of indication, a particular composition (treatment of a natural gas field at Whitney Canyon, Wyoming, United States) is given below (% by weight):

| | |
|---|---|
| Water | 45.2% |
| Nitrogen | 7.7% |
| Benzene | 4.6% |
| Toluene | 15.6% |
| Ethylbenzene | 0.9% |
| Xylene | 12.7% |
| Other hydrocarbons | 13.3% |

The composition of the discharge varies depending on the nature of the gas to be treated, the temperature and the flow rate of the TEG circulating in the facility. This discharge must be reduced in order to comply with new regulations regarding the emission of toxic substances into the atmosphere. As an example, in the United States, the "Clean Air Act Amendment" of 1990 drastically reduces the acceptable levels of BTEX discharged into the atmosphere on American territory. All units discharging more than 100 tonnes/year of BTEX or 25 tonnes/year of any combination of these 4 compounds are monitored and regulated.

In order to comply with the new regulations on the emission of toxic substances into the atmosphere, the manufacturers concerned have modified existing gas dehydration units using the following techniques:

Vapour incineration, which can be carried out in a flame incinerator supplied with fuel gas produced by the unit, which has the disadvantage of requiring very high investment.

Vapour condensation to produce water and BTEX and gravity separation in a three-phase separation drum is described in detail in U.S. Pat. No. 3,867,736 and shown schematically in FIG. 2. In this technique, the gaseous discharges leaving overhead of thermal regeneration apparatus R1 are sent via line 8 to a condenser C1, usually an air-cooled exchanger. The various fluids leaving condenser C1 are sent to a three-phase separation drum B1 where a liquid phase containing mainly water is evacuated via line 11, and a liquid phase containing mainly hydrocarbons is extracted as a side stream via line 10, separation occurring under gravity. The gaseous phase leaving three-phase drum B1 via line 9 is composed of water vapour and contains a residual amount of hydrocarbons which frequently exceeds the environmental limits, as will be seen in Example 2 below.

An industrial process is known which uses two condensers like C1 and two three-phase drums like B1. Such a process can treat the vapours emitted by flash separation drum S1 and by regeneration column R1.

U.S. Pat. No. 5,209,762 describes an improvement over the above process which can eliminate the aromatics dissolved in the liquid water extracted from the three-phase drum.

In another technique, a primary condenser is installed in the vapour circuit, followed by a screw-type compressor. The non condensable vapours are reintroduced into the treatment unit.

In a further technique, a gas is dried and treated using a solvent composed of a glycol, N-methyl caprolactam and water. The concentration of the glycol (preferably TEG) is in the range 80% to 97%. This method is described in U.S. Pat. No. 4,479,811.

Finally, gas permeation has been described for this application, in U.S. Pat. No. 5,399,188. A mixture of water and TEG circulates inside a bundle of hollow fibres in a chamber. The wet gas containing BTEX is sent to the chamber. Only water mixed with glycol passes through the membrane. The following is recovered at the chamber outlet:

- a gas which always contains BTEX;
- a solution containing water and TEG, which can be regenerated without risking BTEX emissions.

SUMMARY OF THE INVENTION

This invention concerns a novel process which involves the condensation of vapours from the desiccant regeneration apparatus.

In particular, the process of the invention has the advantage of producing purified gaseous effluents which can be discharged directly into the atmosphere or through a conventional flare system (without an incinerator) or which can be re-used in the facility.

In general, the invention provides a process for dehydrating a wet gas selected from natural gas and refinery gases, essentially containing methane and other light alkanes, BTEX, water and possibly carbon dioxide, nitrogen and/or hydrogen sulphide, using a hydrophilic liquid desiccant, with regeneration of said liquid desiccant, said process comprising:

(a) a step for absorbing water and BTEX by contacting said wet gas with the liquid desiccant which has been regenerated in step (c), producing a dry effluent gas and a stream of liquid desiccant charged with water and BTEX;

(b) a step for separating said charged liquid desiccant into a vapour containing mainly methane, water vapour and a portion of the BTEX, and a liquid phase containing mainly the liquid desiccant charged with water and BTEX;

(c) a step for regenerating said liquid desiccant, comprising a reboiling zone and a distillation zone, in which the charged liquid desiccant is sent to said distillation zone, from which a vapour containing water and BTEX and said regenerated liquid desiccant are extracted, which latter is sent as the desiccant to the inlet to said absorption zone of step (a);

(d) a step for condensing the vapour from said distillation zone, followed by separation into three phases: a gaseous effluent containing BTEX, a liquid hydrocarbon phase containing BTEX and an aqueous liquid phase; and (e) treating at least said gaseous effluent containing BTEX in a washing zone by absorbing the BTEX with a fraction of the regenerated liquid desiccant which is taken from a point in the process and returning said desiccant, having absorbed the BTEX, to a point in the regeneration zone of step (b), the gaseous effluent leaving said washing zone having been freed of BTEX.

DETAILED DESCRIPTION

Figure 1:
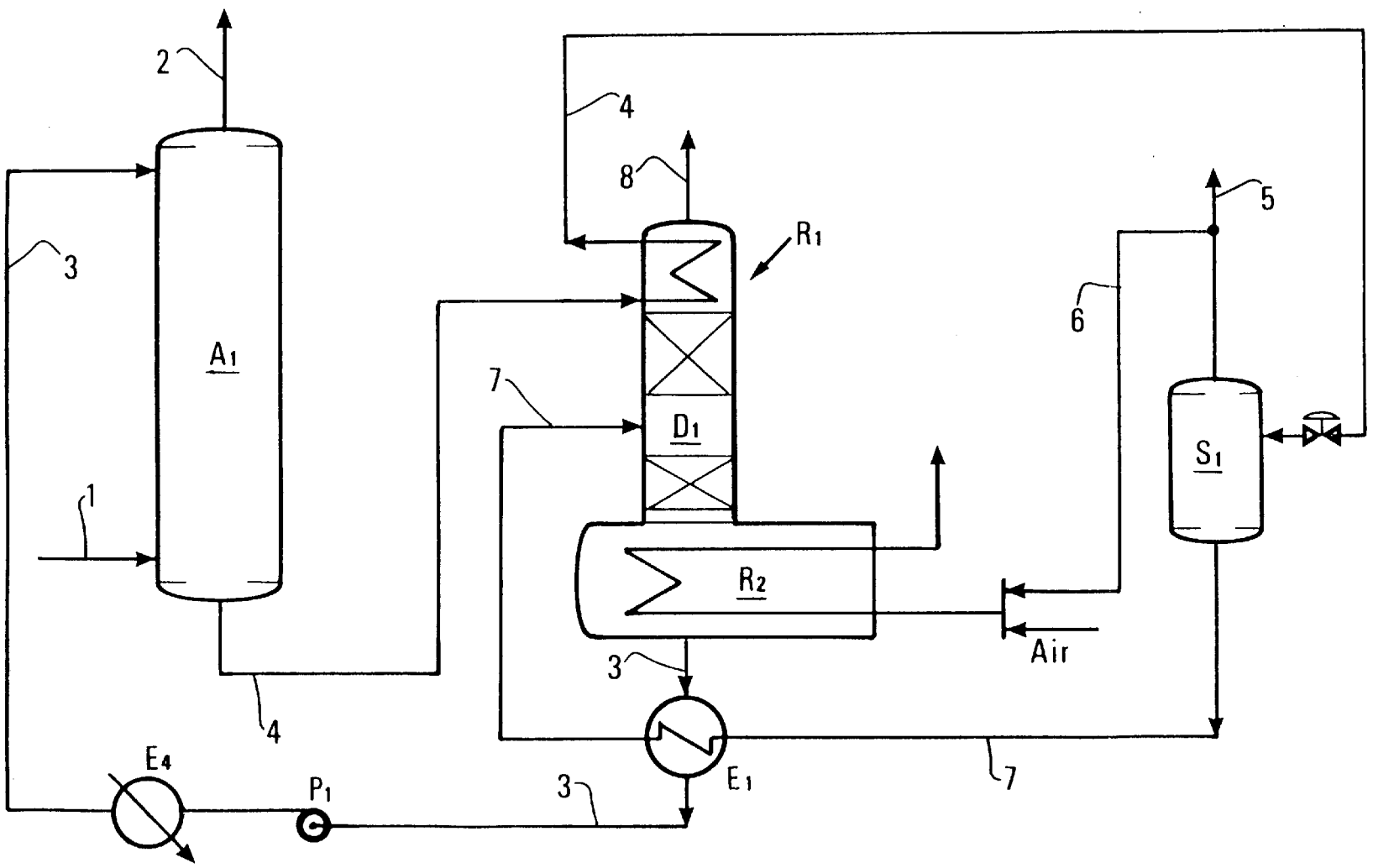
FIG.1 PRIOR ART
FIGS. 1–7 are schematic flow sheets, with FIGS. 1 and 2, as previously described being related to prior art embodiments, and FIGS. 3–7 being preferred embodiments of the invention.

The process of the invention will now be described in more detail with reference to FIG. 4:

In step (a), the wet gas stream 1 is brought into contact with a counter-current of liquid desiccant 3 in absorption column A1, producing a dry gaseous effluent 2 leaving overhead and a stream of liquid desiccant 4 charged with water and BTEX which leaves the bottom of said absorption column A1.

In this step, the wet gas enters at the production pressure (generally 20 to 150 bar) and at a temperature below 50° C. If the gas production temperature is higher than this value, the gas will be cooled, for example using an air-cooled exchanger, before it enters column A1. The liquid desiccant introduced to the head of column A1 is, as is conventional, at a temperature which is about 5° C. higher than that of the gas to be treated.

In step (b), the charged liquid desiccant 4 is sent to a flash separation drum S1, in which a vapour effluent 5 is separated which leaves overhead, containing mainly methane, water vapour and BTEX, and a liquid phase 7, which contains mainly liquid desiccant charged with water and BTEX, leaves from the bottom.

In this step, the stream of liquid desiccant charged with water and BTEX leaves via line 4 at the temperature of the gas to be treated; it is generally sent as a cooling fluid to the head of distillation column D1 of regeneration apparatus R1, where the temperature of the desiccant generally increases by about 10° C. The pressure of the desiccant sent to the flash separation drum S1 is reduced to 2 to 5 bars and its temperature, depending on the operating conditions, can vary between 50° C. and 85° C.

In step (c), the liquid desiccant stream 7 is passed through a heat exchanger E1 to distillation column D1 of regeneration apparatus R1, which also includes a reboiler R2. From regeneration apparatus R1, a vapour effluent 8 which contains water and BTEX leaves overhead. A liquid effluent 3 which constitutes the regenerated liquid desiccant leaves from the bottom, passes through heat exchanger E1 and pump P1 and is sent to the head of absorption column A1 of step (a).

In this step, the liquid desiccant stream is reheated in exchanger E1, which is dimensioned so as to accommodate a variation of temperature of at least about 100° C. between stream 7 (heated) and stream 3 (cooled). Vapour effluent 8 generally leaves distillation column D1 at a temperature of about 80° C. to 90° C. and at atmospheric pressure. The regenerated liquid desiccant leaves the bottom of reboiler R2 at a temperature of about 200° C. and is reduced in temperature by at least about 100° C. in exchanger E1 as indicated above. The temperature of the regenerated desiccant is adapted to the conditions in column A1: it is cooled, generally in an exchanger E4, to a temperature which is about 5° C. higher than that of the gas to be treated. The pressure is also adapted using pump P1 to the pressure in absorption column A1.

In step (d), the gaseous effluent 8 leaving overhead from distillation column D1 of regeneration apparatus R1 is condensed in a condenser C1 and sent to a three-phase separation drum B1, from which a gaseous effluent 9 containing BTEX leaves from its upper portion, a hydrocarbon phase 10 leaves as a side stream and an aqueous liquid phase 11 leaves the bottom.

The overhead effluent from distillation column D1 is cooled in condenser C1, which is usually an air-cooled exchanger, to about 50° C. or less depending on the operating conditions. The three-phase separation drum B1 is at this temperature and at atmospheric pressure: this is also the case for gaseous effluent 9.

Finally, in step (e), the gaseous effluent 9 is sent as an upflow to washing column L1, in which it is brought into contact with a counter-current of a liquid stream 12 which has been removed from the regenerated liquid desiccant circuit. A stream of liquid desiccant 13 which has absorbed BTEX leaves the bottom of said washing column L1, and is returned to regeneration apparatus R1, and a gaseous effluent which is free of BTEX leaves overhead.

In this step, the stream of regenerated liquid desiccant used for washing generally represents 3% to 10% of the stream injected to absorption column A1. In order for washing to be effective, the temperature of the desiccant used is advantageously at least 5° C. higher than that of the gaseous effluent to be treated. This temperature is adapted to the operating conditions, generally by means of a heat exchanger E3. The injected desiccant leaves the bottom of washing column L1 at the temperature of the gaseous effluent to be treated.

Different configurations can be envisaged for carrying out the process of the invention.

Figure 4:
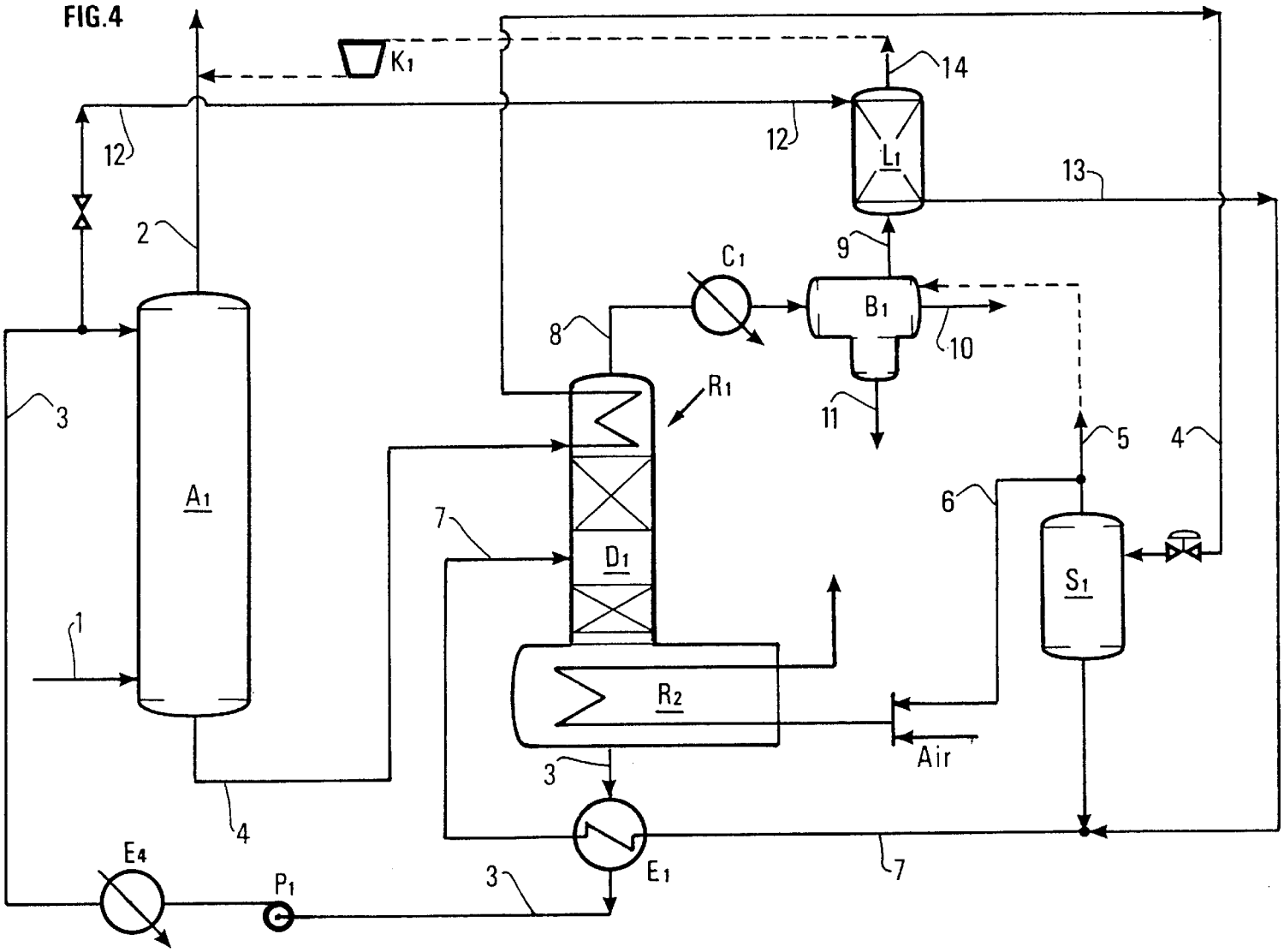
Figure 5:
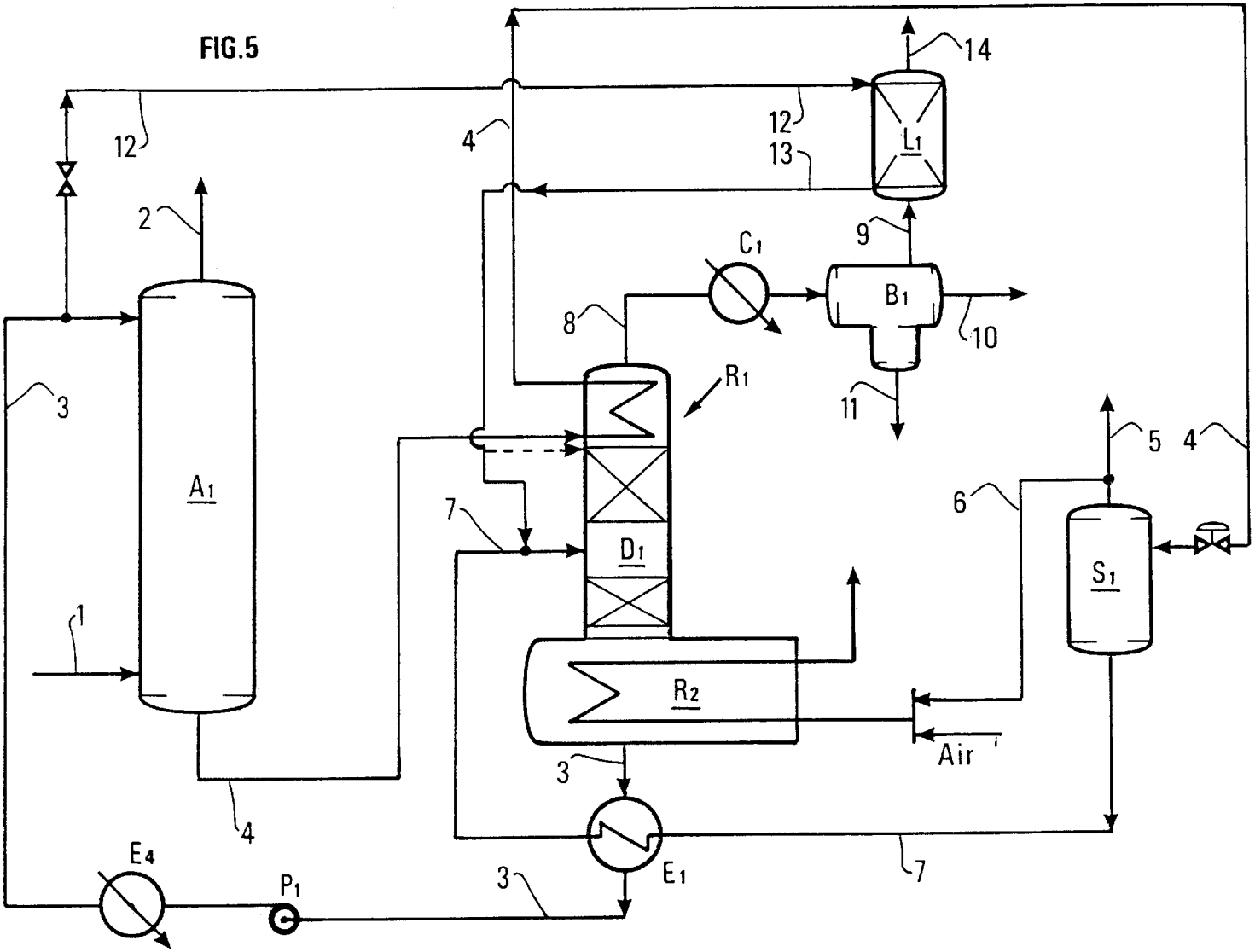
Figure 6:
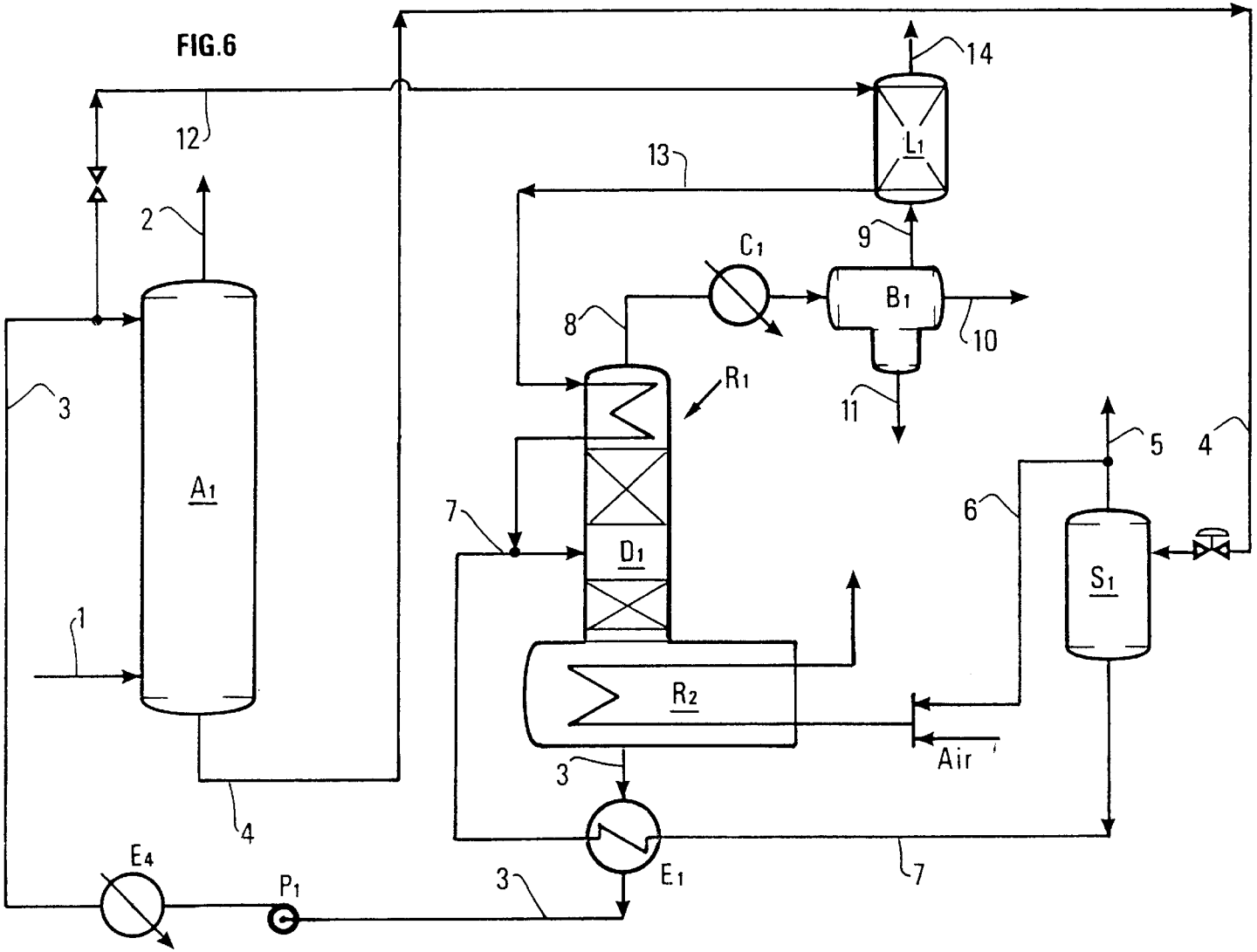

Thus the regenerated desiccant used to wash the gaseous effluents from three-phase separator B1 can be removed from the supply to absorber A1 as shown in the arrangement of FIGS. 4 to 6. This configuration avoids the need to install an exchanger and a pump on site.

In this case, the desiccant charged with BTEX which leaves the bottom of washing column L1 via line 13 can be sent to supply 7 for distillation column D1 upstream of heat exchanger E1, as shown in FIG. 4.

The desiccant charged with BTEX leaving washing column L1 via line 13 can also be sent to supply 7 for distillation column D1 downstream of heat exchanger E1, as shown in FIG. 5.

It can also be injected directly to the head of distillation column D1 of regeneration apparatus R1, or to an intermediate level as shown in dotted lines in FIG. 5.

In these different cases, the supplementary energy consumption of the reboiler caused by addition of this cold fluid is low, since only a small fraction of the desiccant stream is used for this washing operation.

It is also possible to carry out heat exchange between the desiccant leaving column L1 and the head of the regeneration column by causing a partial reflux as indicated in FIG. 6. This disposition means that the desiccant can be reheated while all or a portion of the condensation required at the head of regeneration column D1 takes place.

Figure 3:
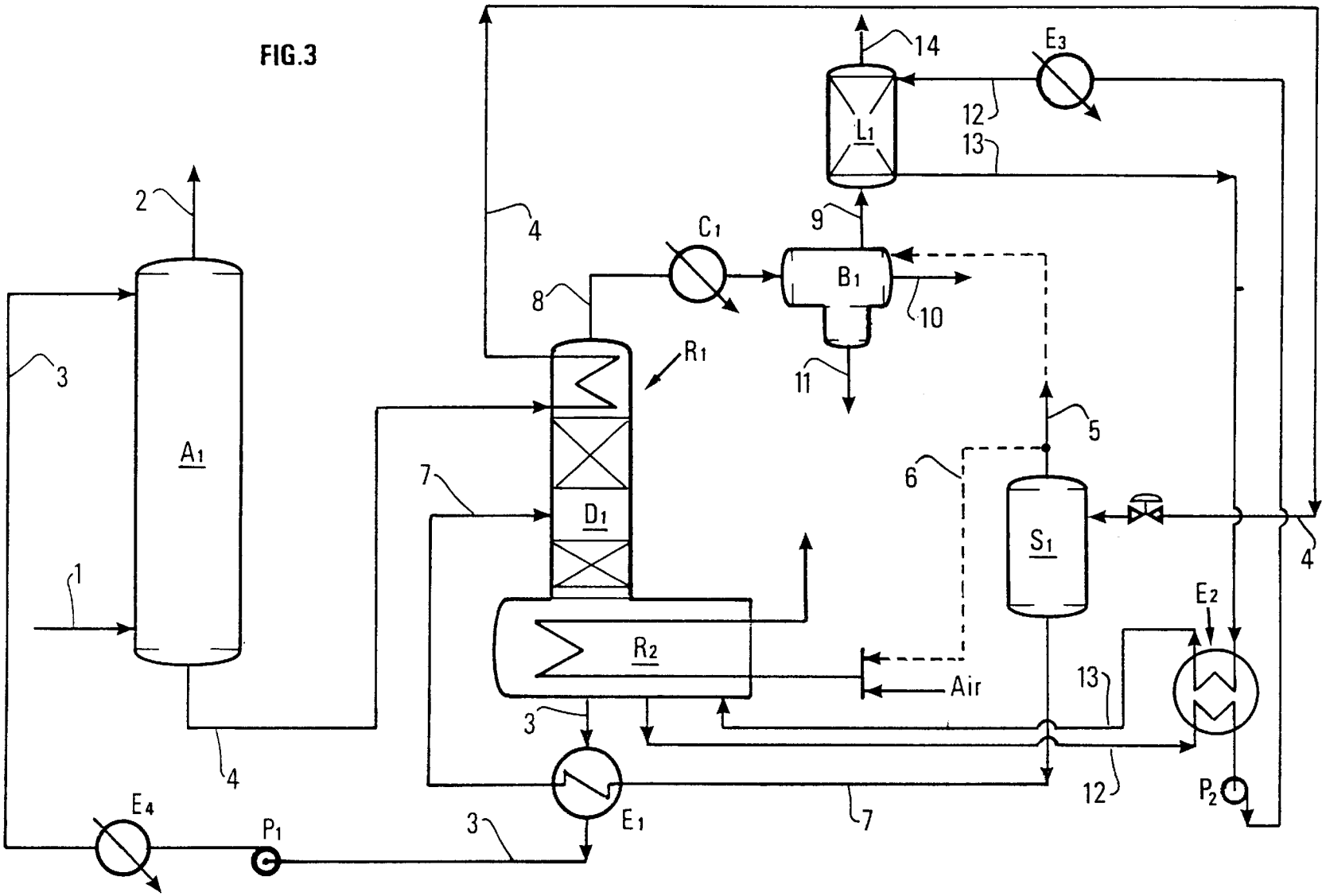

In the process of the invention, the regenerated liquid desiccant stream 12 supplying the head of washing column L1 can also be removed from reboiler R2 via a pump P2 and passed through a heat exchanger E2 and if necessary through an exchanger E3, in which it is cooled, and the liquid desiccant 13, having absorbed the BTEX and leaving the bottom of washing column L1 is returned, passing through heat exchanger E2 in which it is reheated, to reboiler R2. This configuration is shown in FIG. 3.

In order to substantially improve the dehydration of a natural gas or a refinery gas, regeneration of the liquid desiccant in the process of the invention can include a stripping operation, for example using a stripping agent which is liquid at ambient temperature and pressure and which forms a heteroazeotrope with water. In general, the stripping agent is a mixture of hydrocarbons containing mainly benzene. The liquid desiccant regeneration process can then be subdivided into the following 6 steps:

1) a reboiling step for the liquid desiccant charged with water;
2) a distillation step for said desiccant comprising at least one distillation stage;
3) a stripping step for the liquid desiccant which is partially regenerated during steps 1 and 2, using the vaporised stripping agent;
4) a step for condensing the vapour leaving distillation step 2, condensation generating two liquid phases, one of which is mainly water, the other of which is mainly stripping agent;
5) heating the liquid phase which is rich in stripping agent from step 4, heating generating a vapour phase which is richer in water than said liquid phase, and a liquid phase which is depleted in water; and
6) returning the liquid phase, which is constituted essentially by stripping agent, from step 5 to step 3.

Figure 7:
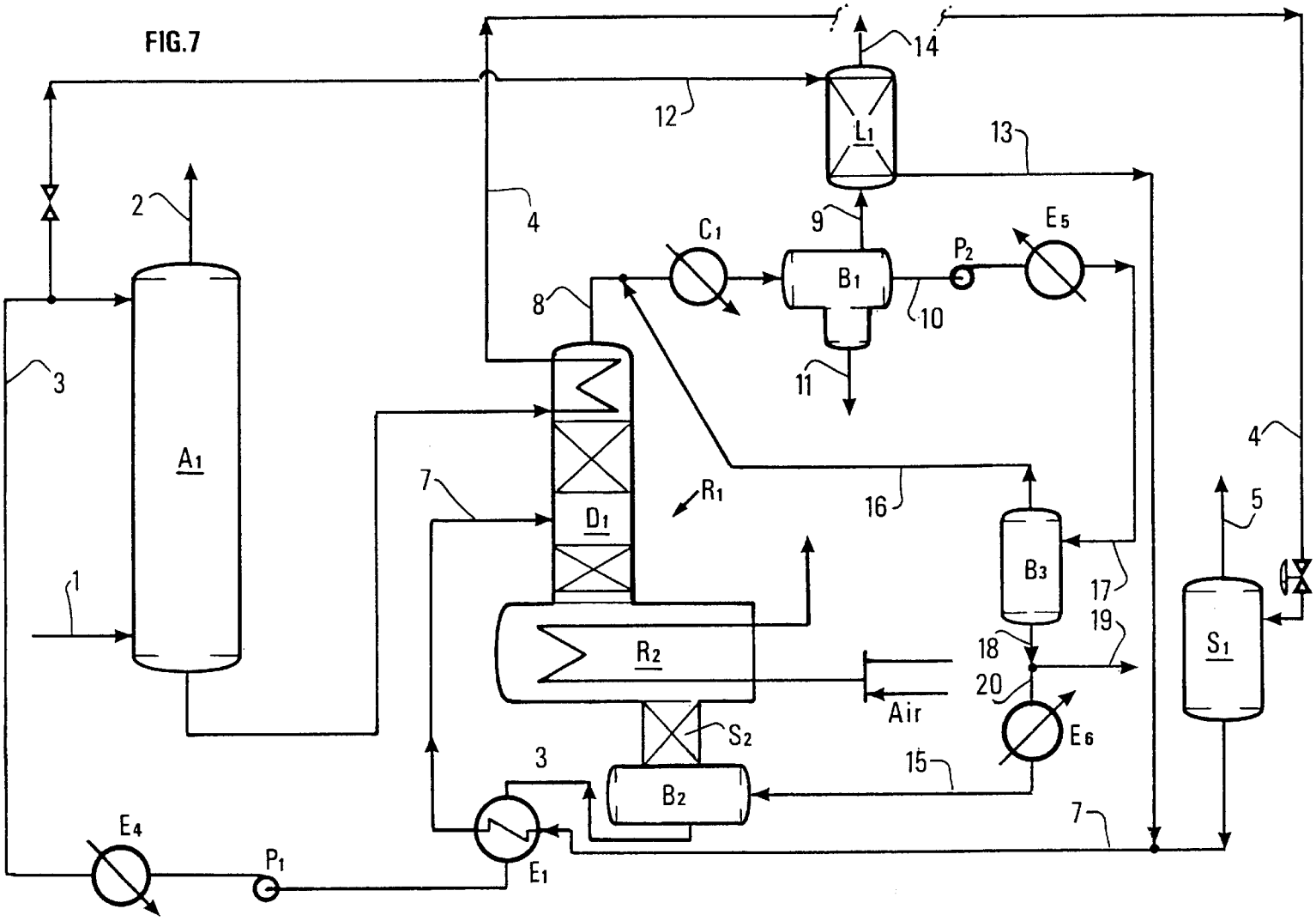

A particular implementation of the process is described in more detail below with reference to FIG. 7. In this implementation, the liquid stripping agent from step 4 is partially vaporised during a first heating step, generating a vapour phase which is enriched in water which is returned upstream of step 4, and a liquid phase which is depleted in water, which is vaporised before being sent to step 1.

This disposition means that the liquid desiccant can be stripped by a vapour phase which contains practically no more water and thus to obtain more effective regeneration of the liquid desiccant.

The feed to be treated arrives via line 4 at the head of distillation apparatus D1. After passing into flash separation drum S1, it is sent via line 7 to exchanger E1 where it is heated by the regenerated liquid desiccant arriving via line 3. The feed leaves exchanger E1 via line 7 and passes into distillation apparatus D1, which is over, successively from top to bottom, a reboiling zone R2, a stripping zone S2 and a reservoir tank B2.

The temperature in reboiling zone R2 is generally in the range 150° C. to 250° C.

The absolute pressure in the ensemble constituted by distillation apparatus D1, reboiler R2, stripping zone S2 and drum B2 is generally in the range 0.5 to 2 bar.

In reboiler R2, the major portion of the water and products which are lighter than the desiccant absorbed by the latter are vaporised. The liquid desiccant, which is depleted in water, falls under gravity from reboiler R2 into stripping zone S2, where it is brought into contact with a counter-current of dehydrated stripping agent arriving in drum B2 via line 15.

The regenerated liquid desiccant leaves drum B2 via line 3, passes through exchanger E1, where it is cooled by the feed arriving via line 7, and is re-injected at the head of absorption column A1, via pump P1.

The water, stripping agent and other products which are vaporised in reboiler R2 leave distillation apparatus D1 via line 8 and are mixed, if necessary, with vapour arriving from drum B3 via line 16, and cooled in condenser C1. The partially condensed mixture enters drum B1.

From this, the lightest compounds are evacuated from the process in gaseous form via line 9; water is evacuated from the process via line 11 with other hydrophilic compounds; the stripping agent and other hydrophobic compounds are sent, saturated in water, via line 10 and through pump P2, to exchanger E5, where they are partially vaporised and sent via line 17 to drum B3.

In general, the vapour phase generated in exchanger E5, which is richer in water than the liquid arriving via line 10, can be evacuated from the process. However, it is more advantageous to return it via line 16 upstream of condenser C1 with the vapour leaving distillation apparatus D1 via line 8.

The liquid phase leaving drum B3 via line 18, which is more depleted in water than the liquid arriving via line 10, is divided so as to maintain constant the flow rate of the stripping agent in the circuit: a fixed portion is sent to evaporator E6 via line 20; any excess, due to absorption by the desiccant of a portion of the gaseous stream treated during the dehydration step, is evacuated from the process via line 19.

The vapour phase leaving evaporator E6 via line 15 is sent to drum B2.

It is known that, during exploitation of a natural gas field, the composition of the gas can vary and have a varying concentrations of aromatic compounds, as described in "Glycol Experience in the Brae Field", J. H Miller and K. A. O'Donnell, presented in London at the conference entitled "Developments in Separation Systems" in March 1993. The use of a stripping step as described above must be accompanied by monitoring of the stripping agent level. When a gas which is rich in aromatic compounds is produced, the volume of stripping agent increases during step 3, and occasionally the three-phase separator B1 must be purged and the surplus of aromatic compounds sent to flash separator B3. If the gas contains no aromatic compounds, it will become charged with these compounds during step 3. During step 4, the liquid phase which is mainly water will condense, while the second liquid phase which is mainly stripping agent will have a low volume or will not exist. The volume of stripping agent contained in the process can thus reduce and will have to be made up. One operating mode used in the North Sea to overcome variations in the aromatics contained in the gas produced consists of alternating periods of normal use of the process with periods during which fuel gas is used as the stripping agent. These latter periods mean that a reserve of stripping agent can be formed.

When the stripping agent is combined with the process of the invention, this mode of operation is no longer necessary. Almost the whole of the aromatic BTEX compounds are recovered and concentrated in three-phase drum B1 and the BTEX can advantageously be used to overcome variations in the volume of stripping agent.

The aromatics arriving in the feed accumulate in drum B1 and the purge line 19 can be operated to keep the quantity of stripping agent contained in drum B1 constant, for example by controlling the purge flow rate using a level regulator.

The purge can be carried out either at the outlet to drum B1 by controlling the level in drum B1, or at the outlet to drum B3 by controlling the level in drum B3. This latter disposition has the advantage of producing a dehydrated liquid fraction. This liquid fraction can either be remixed with the gas then vaporised, or can be separately upgraded.

In the process of the invention, it may be of advantage to use at least one portion 6 of gaseous effluent 5 from flash separation drum S1 as a gaseous fuel for reboiler R2.

Gaseous effluent 5 from flash separation drum S1 can be injected into three-phase drum B1, where it can be injected in partially condensed form. The vapour joins with that separated in drum B1 and which leaves therefrom via line 9 for treatment in washing column L1 in accordance with the invention. This possibility is represented as dotted lines in FIG. 4.

It is also possible to install a washing column L2 for gaseous effluent 5 from flash separation drum S1, which is supplied overhead with regenerated liquid desiccant, with the same possibilities of removal and return as those described above for washing column L1.

The gaseous effluent leaving column L1 via line 14 is free of the BTEX fraction but is also dehydrated. It can thus be recompressed by compressor K1 and mixed with the treated gas as indicated in FIG. 4. Optionally, and depending on the composition of the gas to be treated, the streams of effluents 2, 5 and 14, effluent 5 or the gaseous effluent from washing column L2 treating effluent 5 can be combined with effluent 14. The production yield of the treated gas can thus be improved, constituting a supplemental advantage of the process. Effluent 14 can also be used as a fuel for heating reboiler R2 of regeneration system R1.

The following examples illustrate the invention.

EXAMPLES

In the examples, a natural gas field was considered which produced 220 MSCFD (Millions of Standard Cubic Feet per Day), i.e., 5896 millions of (s) $m^3$/day of gas with a dry composition as given in column 1 of Table 1. The molar mass of the dry gas was 21.5 g/mole, i.e., 0.37% by weight of BTEX. This gas was saturated with water at the production temperature and pressure (51° C., 61 bar) and contained 390 kg of water per million $m^3$.

Example 1

Comparative

The gas was sent to a conventional dehydration unit operating with TEG, as shown in FIG. 1.

In this example:

the flow rate of the TEG circulating in the process was 32000 $m^3$/day;

the regenerated TEG injected at the head of absorber A1 contained 1.2% by weight of residual water;

absorber A1 operated at 51° C. and 61 bar;

flash separation drum S1 operated at 85° C. and 5 bar. The BTEX concentration in the gaseous effluent (7.49 kg/h) meant that it could be used as fuel gas. However, local conditions or strict legislation could necessitate its treatment;

the temperature in the reboiler of regeneration column 4 was 204° C.;

regeneration was carried out at atmospheric pressure.

The composition of effluent 8 from regenerator R1 is shown in column 2 of Table 1. A unit of this type discharged 56.9 kg/h of BTEX.

Example 2

Comparative

Figure 2:
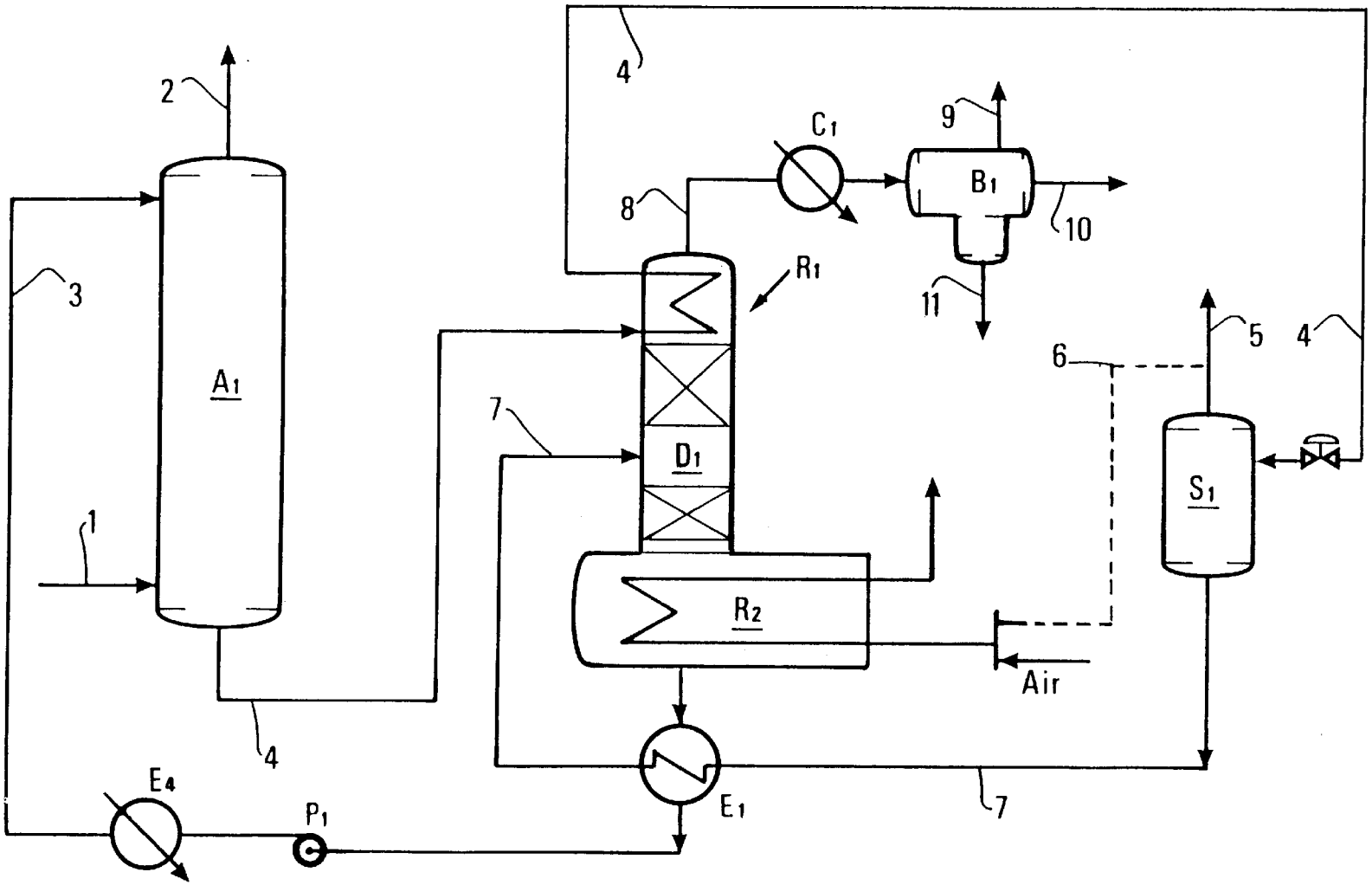
PRIOR ART FIG.2

The gas was dehydrated using a conventional unit comprising a condenser, reducing the temperature of the vapours from regeneration column R1 to 55° C., and a three-phase gravity separation drum (FIG. 2). All the other operating conditions were identical to those of the example described above.

The composition of gaseous effluent 9 from the three-phase drum is shown in column 3 of Table 1. Such a unit discharged 29.8 kg/h of BTEX.

Example 3

According to the Invention

The gas was dehydrated with a unit including a condenser, reducing the temperature of the vapours from regeneration column 4 at 55° C., and a three-phase gravity separation drum. The vapours leaving that drum were taken into washing column L1 described in FIG. 4.

In this example:

the washing column comprised at least three theoretical stages;

the flow rate of stream 12 of regenerated TEG from the regeneration column injected at the head of the washing column was 500 kg/h.

The composition of effluent 14 from that column is shown in column 4 of Table 1. Such a unit only discharged 3.9 kg/h of BTEX.

TABLE 1

| | [1] weight % | [2] kg/h | [3] kg/h | [4] kg/h |
|---|---|---|---|---|
| Water | | 938.93 | 9.75 | 0.64 |
| Carbon dioxide | 11.19% | 18.78 | 18.60 | 18.28 |
| Hydrogen sulphide | 3.88% | 58.97 | 57.60 | 54.88 |
| Nitrogen | 0.17% | 0.05 | 0.05 | 0.05 |
| Methane | 58.96% | 1.36 | 1.36 | 1.34 |

TABLE 1-continued

| | [1] weight % | [2] kg/h | [3] kg/h | [4] kg/h |
|---|---|---|---|---|
| Ethane | 9.70% | 1.58 | 1.58 | 1.56 |
| Propane | 5.89% | 2.40 | 2.36 | 2.32 |
| Butanes | 4.38% | 2.47 | 2.38 | 2.34 |
| Pentanes | 2.35% | 9.34 | 8.44 | 8.07 |
| n-hexane | 1.39% | 9.12 | 7.12 | 6.67 |
| Other hexanes | 0.07% | 1.41 | 1.16 | 1.01 |
| Heptanes | 0.82% | 8.39 | 4.46 | 4.29 |
| BENZENE | 0.06% | 9.12 | 5.63 | 1.92 |
| TOLUENE | 0.18% | 41.32 | 15.90 | 1.88 |
| ETHYLBENZENE | 0.01% | 1.52 | 0.29 | 0.01 |
| XYLENE | 0.13% | 4.99 | 7.98 | 0.07 |
| Total BTEX | 0.38% | 56.95 | 29.80 | 3.88 |
| Heavy compounds | 0.83% | 0.15 | 0.03 | 0.03 |
| Total | | 1109.89 | 144.69 | 105.36 |

[1] Composition (weight %) of anhydrous gas at absorption column inlet
[2] Effluent from regeneration column (Comparative Example 1)
[3] Effluent from three-phase separation drum (Comparative Example 2)
[4] Effluent from washing column (Example 3 according to the invention)

The preceding examples can be repeated with similar success by substituting the generically or specifically described reactants and/or operating conditions of this invention for those used in the preceding examples.

The entire disclosure of all applications, patents and publications, cited above and below, and of corresponding French application 95/12689, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

In the following claims, the term "BTEX" is meant to define at least one member selected from the group consisting of benzene, toluene, ethylbenzene and xylenes. As seen from the above examples, all four members are often present in the natural gas or refinery gas to be dehydrated. This invention, however, is applicable to the dehydration of wet gases having one, two, three, as well as four or more members of "BTEX."

We claim:

1. A process for dehydrating a wet natural gas or refinery gas comprising methane and other light alkanes, BTEX, water and optionally at least one of carbon dioxide, nitrogen and hydrogen sulphide using a hydrophilic liquid desiccant, with regeneration of said liquid desiccant, said process comprising:

(a) a step for absorbing water and BTEX by contacting said wet gas with the liquid desiccant which has been regenerated in step (c), producing a dry effluent gas and a stream of liquid desiccant charged with water and BTEX;

(b) a step for separating said charged liquid desiccant into a vapour containing mainly methane, water vapour and a portion of the BTEX, and a liquid phase containing mainly the liquid desiccant charged with water and BTEX;

(c) a step for regenerating said liquid desiccant, comprising a reboiling zone and a distillation zone, in which the liquid desiccant charged with water and BTEX is sent to said distillation zone, from which a vapour containing water and BTEX and said regenerated liquid desiccant are extracted, which latter is sent as the desiccant to the inlet to said absorption zone of step (a);

(d) a step for condensing the vapour from said distillation zone, followed by separation into three phases: a gaseous effluent containing BTEX, a liquid hydrocarbon phase containing BTEX and an aqueous liquid phase; and (e) treating at least said gaseous effluent containing BTEX in a washing zone by absorbing the BTEX with a fraction of the regenerated liquid desiccant taken from a point in the process and returning said desiccant, having absorbed the BTEX, to a point in the regeneration zone of step (c), the gaseous effluent leaving said washing zone having been freed of the BTEX.

2. A process according to claim 1, wherein:

in step (a), the wet gas stream (1) is brought into contact with a counter-current of liquid desiccant (3) in absorption column A1, producing a dry gaseous effluent (2) leaving overhead and a stream of liquid desiccant (4) charged with water and BTEX which leaves the bottom of said absorption column A1;

in step (b), the charged liquid desiccant (4) is sent, after passing inside the head of distillation column D1, to a flash separation drum S1, in which a vapour effluent (5) is separated which leaves overhead, containing mainly methane, water vapour and BTEX, and a liquid phase (7), containing mainly the liquid desiccant charged with water and BTEX, leaves from the bottom;

in step (c), the desiccant stream (7) which is charged with water and BTEX is passed through a heat exchanger E1 to distillation column D1 of regeneration apparatus R1, which also includes a reboiler R2; from said regeneration apparatus, a vapour effluent (8) leaves overhead which contains water and BTEX, and a liquid effluent (3) which constitutes the regenerated liquid desiccant leaves from the bottom, passes through heat exchanger E1 and is sent tot he head of adsorption column A1 of step (a);

in step (d), said gaseous effluent (8) leaving overhead from distillation column D1 of regeneration apparatus R1 is condensed in a condenser C1 and sent to a three-phase separation drum B1, from which a gaseous effluent (9) containing BTEX leaves from its upper portion, a hydrocarbon phase (10) containing BTEX leaves as a side stream and an aqueous liquid phase (11) leaves the bottom;

and in step (e), the gaseous effluent (9) is sent as an upflow to washing column L1, in which it is brought into contact with a counter-current of a liquid stream (12) which has been removed from the regenerated liquid desiccant circuit; a stream of liquid desiccant (13) which has absorbed the BTEX leaves the bottom of said washing column L1 and is returned to regeneration apparatus R1, and a gaseous effluent which is free of BTEX leaves overhead.

3. A process according to claim 2, wherein the stream of regenerated liquid desiccant (12) supplying the head of washing column L1 is removed from the regenerated liquid desiccant supply (3) to the absorption column A1.

4. A process according to claim 3, wherein the liquid desiccant (13), having absorbed the BTEX and leaving the bottom of washing column L1, is returned to the supply (7) to distillation column D1 of regeneration apparatus R1, upstream of heat exchanger E1.

5. A process according to claim 3, wherein the liquid desiccant (13), having absorbed the BTEX and leaving the bottom of washing column L1, is returned to the supply (7) to distillation column D1 of regeneration apparatus R1, downstream of heat exchanger E1.

6. A process according to claim 3, characterized in that the liquid desiccant (13), having absorbed the BTEX and leaving the bottom of washing column L1, is returned directly to the head of distillation column D1 of regeneration apparatus R1.

7. A process according to claim 2, wherein the stream of regenerated liquid desiccant (12) supplying the head of washing column L1 is removed from the reboiler R2 via a pump P2 and through a heat exchanger E2, in which it is cooled, and liquid desiccant (13), having absorbed the BTEX and leaving the bottom of washing column L1 is returned through heat exchanger E2, in which it is reheated, to reboiler R2.

8. A process according to claim 1 it further comprising a stripping step for the liquid desiccant to be regenerated.

9. A process according to claim 8, wherein stripping is carried out using a fraction of dry gas recovered as an effluent from absorption step (a).

10. A process according to claim 8, wherein a liquid stripping agent is used at ambient pressure and temperature and forms a heteroazeotrope with the water, the liquid desiccant regeneration process thus comprising:

1) a reboiling step for the liquid desiccant charged with water;

2) a distillation step for said desiccant comprising at least one distillation stage;

3) a stripping step for the liquid desiccant which has been partially regenerated during steps (1) and (2), using the vaporised stripping agent, 4) a step for condensing the vapour leaving distillation step (2), condensation generating two liquid phases, one of which is mainly water, the other of which is mainly stripping agent, 5) heating the liquid phase which is rich in stripping agent from step (4), generating a vapour phase which is richer in water than said liquid phase and a liquid phase which is depleted in water; and 6) returning the liquid phase which is constituted essentially by stripping agent from step (5) to step (3).

11. A process according to claim 10, wherein the stripping agent comprises aromatic hydrocarbons.

12. A process according to claim 10 wherein in that the hydrocarbon phase (10) containing BTEX leaving the three-phase drum B1 as a side stream is used to make up the stripping agent.

13. A process according to claim 2, wherein at least a portion (6) of the gaseous effluent from flash separation drum S1 is used as a fuel to heat reboiler R2.

14. A process according to claim 2, wherein the gaseous effluent (5) from flash separation drum S1 is injected into the three-phase drum B1.

15. A process according to claim 1 further comprising a washing step in which a vapour from separation step (b) containing BTEX is treated in a washing zone by absorbing the BTEX with a fraction of said regenerated liquid desiccant from step (c).

16. A process according to claim 2, wherein the gaseous effluent (14) from washing column L1 is recompressed and injected into dry gaseous effluent (2).

17. A process according to claim 1, wherein said liquid desiccant is a glycol.

18. A process according to claim 17, wherein said glycol is triethyleneglycol.

* * * * *